US006601565B2

(12) United States Patent
Tofan-Petre

(10) Patent No.: US 6,601,565 B2
(45) Date of Patent: Aug. 5, 2003

(54) PRESSURE REGULATING VALVE AND SYSTEM

(75) Inventor: Cristian Tofan-Petre, Tournefeuille (FR)

(73) Assignee: Siemens Automotive Inc. (CA)

( * ) Notice: Subject to any disclaimer, the term of this patent is extended or adjusted under 35 U.S.C. 154(b) by 0 days.

(21) Appl. No.: 09/984,059

(22) Filed: Oct. 26, 2001

(65) Prior Publication Data

US 2002/0050273 A1 May 2, 2002

Related U.S. Application Data

(60) Provisional application No. 60/244,224, filed on Oct. 30, 2000.

(51) Int. Cl.[7] ..... F02M 37/04

(52) U.S. Cl. ..... 123/457; 123/514; 137/100

(58) Field of Search ..... 123/457, 510, 123/511, 514; 137/563, 565.13, 510, 541, 100

(56) References Cited

U.S. PATENT DOCUMENTS

| | | | | | |
|---|---|---|---|---|---|
| 4,732,131 | A | * | 3/1988 | Hensel | 123/514 |
| 5,113,831 | A | * | 5/1992 | Grant | 123/457 |
| 5,148,792 | A | | 9/1992 | Tuckey | 123/497 |
| 5,186,147 | A | * | 2/1993 | Bellis | 123/457 |
| 5,211,205 | A | * | 5/1993 | Grant et al. | 123/457 |
| 5,339,785 | A | | 8/1994 | Wilksch | 123/457 |
| 5,413,077 | A | | 5/1995 | Hornby et al. | 123/457 |
| 5,435,344 | A | | 7/1995 | Robinson et al. | 137/508 |
| 5,509,444 | A | | 4/1996 | Robinson et al. | 137/508 |
| 5,551,404 | A | * | 9/1996 | Bauerle et al. | 123/514 |
| 5,666,927 | A | | 9/1997 | Pace et al. | 123/533 |
| 5,720,263 | A | * | 2/1998 | Frank et al. | 123/514 |
| 5,749,345 | A | * | 5/1998 | Treml | 123/457 |
| 5,762,047 | A | * | 6/1998 | Yoshioka et al. | 123/514 |
| 5,794,597 | A | * | 8/1998 | Schwegler et al. | 123/514 |
| 5,967,119 | A | | 10/1999 | Burkhard et al. | 123/458 |
| 5,975,061 | A | * | 11/1999 | Briggs et al. | 123/514 |

FOREIGN PATENT DOCUMENTS

| | | |
|---|---|---|
| DE | 198 23 143 | 11/1999 |

* cited by examiner

*Primary Examiner*—Thomas N. Moulis

(57) ABSTRACT

A pressure regulating valve and system, including a pressure regulating valve having a housing defining a chamber with a first passage and second passage; a pressure operative member separating the first and second passages, the member having at least a first and second position, the first passage having a first volume and flow therethrough when the member is in the first position, and the first passage having a second volume and a first portion of the flow therethrough and the second passage having a second portion of the flow therethrough when the member is in the second position; and a spring biasing the member to the first position; an injector communicating with the valve; a diverter communicating with a fuel supply and the valve; a filter between the first outlet and the valve; and a fuel pump located between the fuel supply and the diverter.

19 Claims, 2 Drawing Sheets

PRESSURE REGULATING VALVE AND SYSTEM

REFERENCE TO RELATED APPLICATION

This application claims the benefit of U.S. Provisional Application No. 60/244,224 filed on Oct. 30, 2000, entitled "Pressure Regulating/Diverting Valve."

FIELD OF INVENTION

The invention relates to automotive fuel systems and more particularly, to a pressure regulating valve and system.

BACKGROUND OF INVENTION

In an automotive engine system, fuel may be pumped from a tank through a fuel rail to an injector. It is believed that the pressure of fuel delivered to the injector should be controlled to allow a desired quantity of fuel to pass through the injector into the cylinders of the engine. Pressure regulators may be incorporated in the fuel rail to provide pressure control. Excess fuel that is pumped from the tank through a fuel rail may also be returned to the tank through a return line.

SUMMARY OF THE INVENTION

The invention provides a pressure regulating valve. This valve includes a housing defining a chamber with a first passage and a second passage, a pressure operative member separating the first passage and the second passage and having at least a first and a second position, and a spring biasing the pressure operative member to the first position. The first passage has a first volume with a flow therethrough when the pressure operative member is in the first position, and the first passage has a second volume and a first portion of the flow therethrough and the second passage has a second portion of the flow therethrough when the pressure operative member is in the second position.

The invention also provides a pressure regulating system. This system includes a pressure regulating valve having a housing defining a chamber with a first passage and a second passage, a pressure operative member separating the first passage and the second passage and having at least a first and a second position, and a spring biasing the pressure operative member to the first position; an injector communicating with the first passage of the pressure regulating valve; a diverter having an inlet communicating with a fuel supply, a first outlet communicating with the first passage of the pressure regulating valve, and a second outlet communicating with the second passage of the pressure regulating valve; a filter located between the first outlet and the pressure regulating valve, and a fuel pump located between the fuel supply and the diverter. The first passage has a first volume and a flow therethrough when the pressure operative member is in the first position. The first passage has a second volume and a first portion of the flow therethrough and the second passage has a second portion of the flow therethrough when the pressure operative member is in the second position.

The invention provides another pressure regulating system. This system includes a pressure regulating valve having a housing defining a chamber with a first passage and a second passage, a pressure operative member separating the first passage and the second passage and having at least a first and a second position, and a spring biasing the pressure operative member to the first position; an injector communicating with the pressure regulating valve through the first passage; a fuel tank communicating with the pressure regulating valve; a diverter having an inlet receiving a fuel supply from the fuel tank, a first outlet supplying the flow to the first passage of the pressure regulating valve, and a second outlet supplying the flow to the second passage of the pressure regulating valve; a filter located between the first outlet and the first passage; and a fuel pump located between the fuel supply and the diverter. The pressure operative member has a diaphragm operatively connected to a sealing gasket by a stem. The first passage has a first volume with a flow therethrough when the pressure operative member is in the first position. The first passage has a second volume and a first portion of the flow therethrough and the second passage has a second portion of the flow therethrough when the pressure operative member is in the second position.

The invention further provides a method of supplying fuel to a fuel injector. This method includes a pressure regulating valve having a housing defining a chamber with a first passage and a second passage, a pressure operative member separating the first passage and the second passage and having at least a first and a second position, a diaphragm having a first seat, a sealing gasket, having a second seat, and a stem operatively connected to the diaphragm and the sealing gasket and a spring biasing the pressure operative member to the first position; pumping a flow from a fuel supply to a diverter having an inlet, a first outlet, and a second outlet; supplying a first portion of the flow from the first outlet to the first passage and a second portion of the flow from the second outlet to the second passage; allowing the first portion of the flow from the first passage to an injector; and moving the sealing gasket away from the second seat if a pressure in the first passage exceeds a force exerted by the spring. The first passage has a first volume when the pressure operative member is in the first position. The first passage has a second volume when the pressure operative member is in the second position.

The invention provides another method of supplying fuel to a fuel injector. This method includes a housing defining a chamber with a first passage and a second passage, a pressure operative member separating the first passage and the second passage and having at least a first and a second position, a diaphragm having a first seat and a seating surface, a sealing gasket having a second seat and a seating surface with a diameter substantially equal to a diameter of the seating surface of the diaphragm, and a stem operatively connected to the diaphragm and the sealing gasket, and a spring biasing the pressure operative member to the first position; pumping a flow from a fuel tank to a diverter having an inlet, a first outlet, and a second outlet; supplying a first portion of the flow from the first outlet to the first passage and a second portion of the flow from the second outlet to the second passage; passing the first portion of the flow from the first outlet through a filter; allowing the first portion of the flow from the first passage to an injector, moving the sealing gasket away from the second seat and the diaphragm toward the first seat if a pressure in the first passage exceeds a force exerted by the spring; reducing the first portion of the flow to the first passage and increasing the second portion of the flow to the second passage if the pressure in the first passage exceeds the force exerted by the spring; and returning the second portion of the flow from the second passage to the fuel tank if the pressure in the first passage exceeds the force exerted by the spring. The first passage has a first volume when the pressure operative member is in the first position. The first passage has a second volume when the pressure operative member is in the second position.

BRIEF DESCRIPTION OF THE DRAWINGS

The accompanying drawings, which are incorporated herein and constitute part of this specification, illustrate the presently preferred embodiments of the invention, and together with the general description given above and the detailed description given below, serve to explain the features of the invention.

DETAILED DESCRIPTION OF THE PREFERRED EMBODIMENTS

Reference will now be made in detail to the preferred embodiments of the present invention, examples of which are illustrated in the accompanying drawings. It is to be understood that the Figures and descriptions of the present invention included herein illustrate and describe elements that are of particular relevance to the present invention, while eliminating, for purposes of clarity, other elements found in typical pressure regulation systems.

Figure 1:
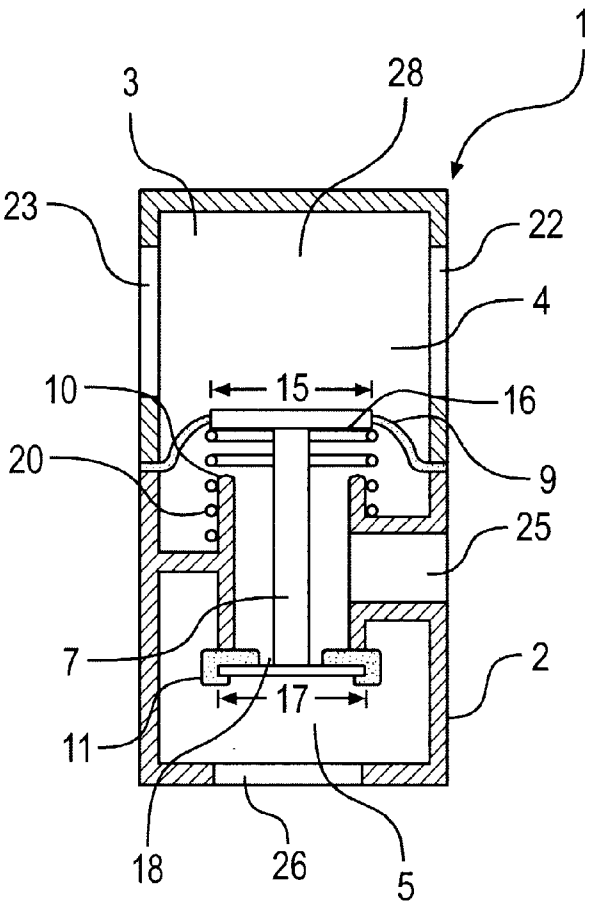
FIG. 1 is a schematic view of a preferred embodiment of the pressure regulating valve of the invention in a first position.

As shown in FIG. 1, in the preferred embodiment, a pressure regulating valve 1 includes a housing 2 defining a chamber 3 with a first passage 4 and a second passage 5. A pressure operative member 7 separates the first passage 4 and the second passage 5. Preferably, the pressure operative member 7 has a diaphragm 9 with a first seat 10 proximate the first passage 4 and a sealing gasket 11 with a second seat 12 proximate the second passage 5. The diaphragm 9 and sealing gasket 11 are, preferably, operatively connected with a stem 14 such that the diaphragm 9 moves with the sealing gasket 11. In the preferred embodiment, a diameter 15 of a seating surface 16 of the diaphragm 9 is substantially equal to a diameter 17 of a seating surface 18 of the sealing gasket 11. A spring 20 biases the diaphragm 9 of the pressure operative member 7 toward the first passage 4.

Figure 2:
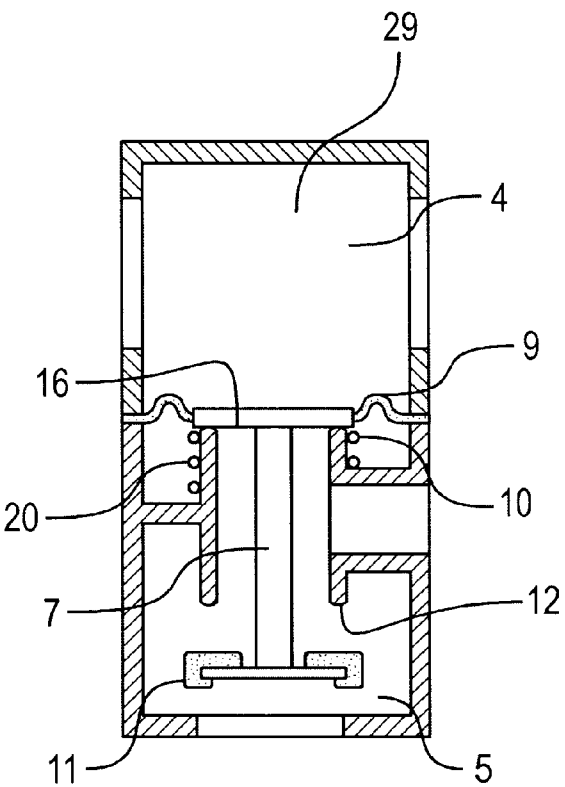
FIG. 2 is a schematic view of the pressure regulating valve of FIG. 1 in a second position.

In the preferred embodiment, the first passage 4 has an inlet 22 and an outlet 23. Clean fuel, preferably, flows into the inlet 22 and exits the first passage 4 through the outlet 23. In the preferred embodiment, the second passage 5 has an inlet 25 and an outlet 26. Non-filtered fuel, preferably, flows into the inlet 25 and exits the second passage 5 through the outlet 26. The first passage 4 has a first volume 28 with a flow therethrough when the pressure operative member 7 is in a first position. The pressure operative member 7 is in the first position when the diaphragm 9 is biased away from the first seat 10 and the seating surface 18 of the sealing gasket 11 engages the second seat 12. As the pressure in the first passage 4 increases, the pressure operative member 7 moves toward the second passage 5. If the pressure of the flow through the first passage 4 exceeds a pressure, or force, exerted by the spring 20, the pressure operative member 7 will move to a second position, as shown in FIG. 2. In the second position, the first passage 4 has a second volume 29. The pressure operative member 7 is in the second position when the seating surface 16 of the diaphragm 9 engages the first seat 10 and the sealing gasket 11 is biased away from the second seat 12. This allows flow through the second passage 5.

Figure 3:
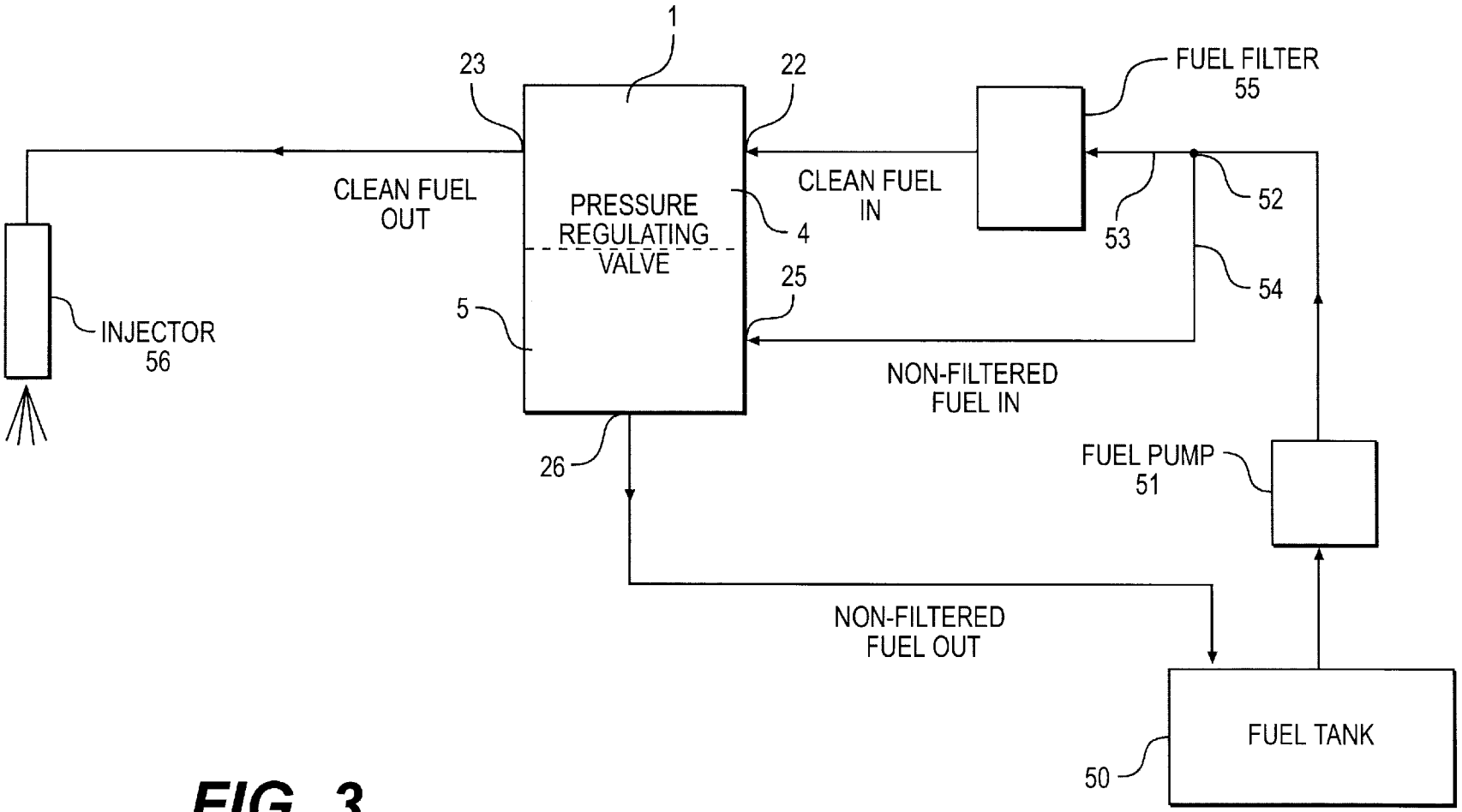
FIG. 3 is a diagram of a preferred embodiment of the system.

The pressure regulating valve 1 described above may be incorporated into a pressure regulatory system, as shown in FIG. 3. The system includes a fuel supply, or fuel tank 50, that provides fuel through a pump 51, or preferably, a fuel pump, to the pressure regulating valve 1. Preferably, the fuel is a liquid or a gas. A diverter 52 communicates with the fuel tank 50 and has a first outlet 53 communicating with the first passage 4 of the pressure regulating valve 1, and a second outlet 54 communicating with the second passage 5 of the pressure valve 1. Preferably, the diverter 52 receives a continuously open fuel supply from the pump 51. Preferably, the pressure regulating valve 1, pump 51, and diverter 52 are located outside of the fuel tank 50. However, it should be understood that any component of the system may be integrated with any other component of the system. For example, the entire system may be enclosed such that only a fuel line in and out are shown, or the valve 1, pump 51, and diverter 52 may be integrated with the fuel tank 50. As discussed above, if the pressure operative member 7 is in the first position, fuel will flow through a filter 55 to the pressure regulating valve 1 into the inlet 22. The filter 55 may be located outside of the valve 1 and diverter 52 or may be integrated with other components of the system, such as the fuel tank 50. The fuel flows through the first passage 4, exits the outlet 23 and then flows to an injector 56. Fuel will also flow into inlet 25 to the second passage 5 of the pressure operative valve 1, but will be blocked by the sealing gasket 11 when the pressure operative member 7 is in the first position.

As the pressure in the first passage 4 increases, fuel will begin to flow through the second passage 5, out of outlet 26, and back to the fuel tank 50. When the pressure in the first passage 4 exceeds the force of the spring 20, the sealing gasket 11 moves away from the second seat 12 and the diaphragm 9 moves toward the first seat 10 to open the second passage 5. Fuel may flow through both the first and second passages 4 and 5 with a portion of the flow in each or the entire flow through either the first passage 4 or the second passage 5. As the flow through the first passage 4 decreases, the flow through the second passage 5 increases. Preferably, fuel flows through the system via piping.

While the invention has been described in detail and with reference to specific features, it will be apparent to one skilled in the art that various changes and modifications can be made therein without departing from the spirit and scope of the invention. It is intended that the present invention cover the modifications and variations of this invention provided they come within the scope of the appended claims and their equivalents.

What is claimed is:

1. A pressure regulating valve comprising:

a housing defining a chamber, the chamber having a first passage and a second passage;

a pressure operative member separating the first passage and the second passage, the pressure operative member having at least a first and a second position, the first passage having a first volume with a flow therethrough when the pressure operative member is in the first position, and the first passage having a second volume and a first portion of the flow therethrough and the second passage having a second portion of the flow therethrough when the pressure operative member is in the second position; and a spring biasing the pressure operative member to the first position.

2. The pressure regulating valve of claim 1, wherein the pressure operative member pressure comprises:

a diaphragm having a first seat;

a sealing gasket having a second seat; and a stem operatively connected to the diaphragm and the sealing gasket.

3. The pressure regulating valve of claim 2, wherein a diameter of a seating surface of the diaphragm is substantially equal to a diameter of a seating surface of the sealing gasket.

4. The pressure regulating valve of claim 1, further comprising a diverter with an inlet communicating with a fuel supply, a first outlet communicating with the first passage, and a second outlet communicating with the second passage.

5. The pressure regulating valve of claim 4, wherein the diverter receives a continuously open fuel supply from a pump.

6. The pressure regulating valve of claim 1, wherein the flow comprises a liquid.

7. The pressure regulating valve of claim 1, wherein the flow comprises a gas.

8. The pressure regulating valve of claim 1, wherein the flow to the first passage passes through a filter.

9. The pressure regulating valve of claim 1, wherein the second portion of the flow through the second passage returns to a fuel supply.

10. The pressure regulating valve of claim 9, wherein the fuel supply comprises a fuel tank.

11. The pressure regulating valve of claim 1, wherein the flow through the first passage passes through a conduit to an injector.

12. A pressure regulating system comprising:

a pressure regulating valve including:

a housing defining a chamber, the chamber having a first passage and a second passage;

a pressure operative member separating the first passage and the second passage, the pressure operative member having at least a first and a second position, the first passage having a first volume and a flow therethrough when the pressure operative member is in the first position, and the first passage having a second volume and a first portion of the flow therethrough and the second passage having a second portion of the flow therethrough when the pressure operative member is in the second position; and a spring biasing the pressure operative member to the first position;

an injector communicating with the first passage of the pressure regulating valve;

a diverter having an inlet communicating with a fuel supply, a first outlet communicating with the first passage of the pressure regulating valve, and a second outlet communicating with the second passage of the pressure regulating valve;

a filter located between the first outlet and the pressure regulating valve; and a fuel pump located between the fuel supply and the diverter.

13. The system of claim 12, wherein the flow comprises fluids.

14. The system of claim 12, wherein the flow comprises gases.

15. The system of claim 12, wherein the pressure operative member comprises:

a diaphragm having a first seat;

a sealing gasket having a second seat; and a stem operatively connected to the diaphragm and the sealing gasket.

16. The system of claim 15, wherein a diameter of a seating surface of the diaphragm is substantially equal to a diameter of a seating surface of the sealing gasket.

17. A pressure regulating system comprising:

a pressure regulating valve including:

a housing defining a chamber, the chamber having a first passage and a second passage;

a pressure operative member separating the first passage and the second passage, the pressure operative member having at least a first and a second position and having a diaphragm operatively connected to a sealing gasket by a stem, the first passage having a first volume with a flow therethrough when the pressure operative member is in the first position, and the first passage having a second volume and a first portion of the flow therethrough and the second passage having a second portion of the flow therethrough when the pressure operative member is in the second position; and a spring biasing the pressure operative member to the first position;

an injector communicating with the pressure regulating valve through the first passage;

a fuel tank communicating with the pressure regulating valve;

a diverter having an inlet receiving a fuel supply from the fuel tank, a first outlet supplying the flow to the first passage of the pressure regulating valve, and a second outlet supplying the flow to the second passage of the pressure regulating valve;

a filter located between the first outlet and the first passage; and a fuel pump located between the fuel supply and the diverter.

18. A method of supplying fuel to a fuel injector, comprising:

providing a pressure regulating valve including:

a housing defining a chamber, the chamber having a first passage and a second passage;

a pressure operative member separating the first passage and the second passage, the pressure operative member having at least a first and a second position, a diaphragm having a first seat, a sealing gasket having a second seat, and a stem operatively connected to the diaphragm and the sealing gasket, the first passage having a first volume when the pressure operative member is in the first position, and the first passage having a second volume when the pressure operative member is in the second position; and a spring biasing the pressure operative member to the first position;

pumping a flow from a fuel supply to a diverter having an inlet, a first outlet, and a second outlet;

supplying a first portion of the flow from the first outlet to the first passage and a second portion of the flow from the second outlet to the second passage;

allowing the first portion of the flow from the first passage to an injector; and moving the sealing gasket away from the second seat if a pressure in the first passage exceeds a force exerted by the spring.

19. A method of supplying fuel to a fuel injector, comprising:

providing a pressure regulating valve including:

a housing defining a chamber, the chamber having a first passage and a second passage;

a pressure operative member separating the first passage and the second passage, the pressure operative member having at least a first and a second position, a diaphragm having a first seat and a seating surface, a sealing gasket having a second seat and a seating surface with a diameter substantially equal to a diameter of the seating surface of the diaphragm, and a stem operatively connected to the diaphragm and the sealing gasket, the first passage having a first volume when the pressure operative member is in the first position, and the first passage having a second volume when the pressure operative member is in the second position; and a spring biasing the pressure operative member to the first position;

pumping a flow from a fuel tank to a diverter having an inlet, a first outlet, and a second outlet;

supplying a first portion of the flow from the first outlet to the first passage and a second portion of the flow from the second outlet to the second passage;

passing the first portion of the flow from the first outlet through a filter;

allowing the first portion of the flow from the first passage to an injector;

moving the sealing gasket away from the second seat and the diaphragm toward the first seat if a pressure in the first passage exceeds a force exerted by the spring;

reducing the first portion of the flow to the first passage and increasing the second portion of the flow to the second passage if the pressure in the first passage exceeds the force exerted by the spring; and returning the second portion of the flow from the second passage to the fuel tank if the pressure in the first passage exceeds the force exerted by the spring.

* * * * *